United States Patent [19]

Baumann

[11] 3,976,427

[45] Aug. 24, 1976

[54] ORGANIC COMPOUNDS

[75] Inventor: Hans-Peter Baumann, Munchenstein, Switzerland

[73] Assignee: Sandoz Ltd., Basel, Switzerland

[22] Filed: Nov. 30, 1973

[21] Appl. No.: 420,723

Related U.S. Application Data

[63] Continuation-in-part of Ser. No. 256,029, May 23, 1972, Pat. No. 3,807,953.

[52] U.S. Cl. ..... 8/173; 8/174; 8/175

[51] Int. Cl.[2] ..... D06P 1/86; D06P 5/04

[58] Field of Search ..... 8/174, 175, 94, 173

[56] References Cited

UNITED STATES PATENTS

| | | | |
|---|---|---|---|
| 1,803,008 | 4/1931 | Ellis et al. | 8/175 |
| 3,627,581 | 12/1971 | Phillips | 252/316 |
| 3,706,530 | 2/1972 | Baumann et al. | 8/174 |
| 3,807,953 | 4/1974 | Baumann | 8/175 |

*Primary Examiner*—Donald Levy
*Attorney, Agent, or Firm*—Gerald D. Sharkin; Richard E. Vila; Thomas C. Doyle

[57] ABSTRACT

The present invention provides a method of dyeing with aqueous dispersed dyes which comprises using as dye carrier a composition comprising 30 to 60 parts by weight of diphenyl, 5 to 35 parts by weight of a phenyl toluene and 5 to 25 parts by weight of fluorene, provided the total of said parts by weight does not exceed 100.

The invention also provides a dye carrier composition as specified above and comprising also an emulsifier.

The invention is particularly useful in the dyeing of polyester fibers.

18 Claims, No Drawings

ORGANIC COMPOUNDS

This application is a continuation-in-part application of co-pending application Ser. No. 256,029, filed May 23, 1972 now U.S. Pat. No. 3,807,953.

The present invention relates to dye carriers for aqueous dispersion dyeing especially of polyester fibres.

The use of carriers in aqueous disperse dyeing, particularly of polyesters, is well known. The amount of dye in the dyeing liquor or paste varies depending upon the actual dyes used, the material to be dyed and the shade desired. The carrier is normally used in large excess relative to the amount of dye (e.g. normally of the order of 10 times as much carrier as dyestuff).

The invention provides a method of dyeing with aqueous dispersed dyes which comprises using as dye carrier a composition comprising 30 to 60 parts by weight of diphenyl, 5 to 35 parts by weight of a phenyl toluene (also known as methyl biphenyl) and 5 to 25 parts by weight of fluorene, provided the total of said parts by weight does not exceed 100.

The diphenyl is preferably present in an amount from 45 to 60 parts by weight, the phenyl toluene 10 to 20 parts by weight and the fluorene 8 to 16 parts by weight.

The dye carrier composition may include other aromatic substances in a further amount from about 1 to about 30 parts by weight, for example naphthalene; diphenyl ether, diphenyl methane; tetrahydronaphthalene anthracene, phenanthrene; chloronaphthalenes; o- and p-phenylphenols; o- and p-cyclohexylphenolxy; alkylphthalimides, in which the alkyl radicals are preferably of 1 to 4 carbon atoms; salicylic acid and cresotinic acid esters, preferably $C_{1-4}$ alkyl such esters; benzoic, phthalic and terephthalic acid esters, preferably benzyl and $C_{1-4}$ alkyl such esters; chlorobenzenes; alkoxylated phenols, preferably alkoxylated chlorophenols, tetralin, dibenzofuran and alkylbenzenes. As examples of alkyl benzenes may be given 1,2,3-trimethylbenzene, 1,2,4-trimethylbenzene and 1,2,5-trimethylbenzene, n-butylbenzene, sec-butylbenzene, tert-butylbenzene, o-, m and p-ethyltoluene, ethylbenzene, p-xylene, m-xylene, o-xylene, 4-tert-butyltoluene, 1,2-, 1,3- and 1,4-diethylbenzene and isopropylbenzene.

The aromatic substances may be unsubstituted or substituted by non-water solubilizing groups such as halogen atoms, nitro, cyano, hydroxyl, alkyl and alkoxy groups.

At temperatures below about 25° to 40°C, these compositions are generally in the form of a white, partially crystalline solid, and are liquid above this temperature. Those of melting point below about 48°C are preferred and those of melting point below 40°C further preferred. Compared with the pure single compounds, their crystallization tendency is substantially lower and this is one of the advantages of the present invention in comparison with the dye carriers so far known, which are essentially pure compounds or mixtures of two essentially pure compounds. For example, carriers consisting of practically pure diphenyl can be added to the dyebath only at temperatures in the vicinity of 60°C or above, as otherwise crystalline precipitates are formed which lead to unlevel dyeings. Diphenyl sublimes readily from dyebaths containing practically pure diphenyl as sole carrier, the sublimate being deposited in crystalline form on the cold components of the machinery, which is not the case with the carriers of this invention.

Compositions which are useful as dye carriers according to this invention may be economically obtained as by-products from the industrial manufacture of aromatic compounds such as benzene, toluene, ethyl benzene or xylenes, for example from dealkylation reactions. They may, of course also be prepared by admixture of the various components.

The compositions of the invention can be emulsified more easily in the dyebath, which greatly facilitates the production of level dyeings with optimum dye yield. The new carriers boil to 90 – 98% in the range of 200° to 290°C. They may be used for dyeing linear saturated aromatic polyester fibres in loose form, as tow, yarn, fabric and in other textile forms and are especially valuable for dyeing textured polyester yarns and fabrics. The carriers of this invention have no significant effect on the light fastness of the dyeings and prints produced with their aid.

Dyeing (which includes exhaust and pad dyeing and printing) using a carrier composition according to this invention is carried out in accordance with standard methods. The carrier may be added to the dyebath, padding liquor or printing paste at room temperature or above and is preferably in finely divided form preferably as an aqueous emulsion, or admixed with an emulsifier, and in an amount to give from 2 to 35% by weight on the substrate. Emulsions can be conveniently prepared with the aid of emulsifiers. Examples of suitable emulsifiers are adducts of ethylene oxide on alkyl phenols such as nonyl phenol and dodecyl phenol or on castor oil, and alkyl benzene sulphonates, dodecyl diphenyl ether disulphonate, neutralized sulphonates from the condensation products of phenol or naphthalene with formaldehyde, and mixtures of the aforenamed emulsifiers.

The emulsifier or emulsifier mixtures are suitably added to the carriers of this invention or to mixtures of these with known carriers in amounts generally ranging from 5 to 30 or preferably from 15 to 25 weight % relative to the amount of carrier.

The preferred emulsifiers contain more than 60 weight %, more especially from 80 to 95 weight %, of an anionic dispersing agent and 5 to 15 weight % of a non-ionic dispersing agent. In choosing the anionic dispersing agent for the emulsifier, preference is given to those which cause minimal foaming with the disclosed carrier mixtures in the dyeing process. Paraffin oil has a favourable effect on the emulsion stability and on the inhibition of foaming and is preferably included in the emulsifier, preferably in an amount of from 0.1 to 7% by weight of the carrier. The suitable anionic emulsifiers include the sulphonates of castor oil, oleic ester, alkyl naphthalene, succinic diethyl hexyl ester, xylene and toluene. Examples of nonionic dispersing agents are the ethers of fatty acids, aryl phenyl and alkyl phenyl polyglycols. Dispersing agents having more than 25–30 ethylene oxide units per molecule are preferably not present in the emulsifier mixture in amounts greater than 5%. Polyglycol ether derivatives with about 6 to 15 mols of added ethylene oxide groups, especially if they are partially carboxymethylated, sulphated or phosphated are conveniently used. Carboxymethylated polyglycol ether derivatives with more than 25 mols of ethylene oxide are comparable in their action to non-carboxymethylated emulsifiers with a similar ethylene oxide content.

The use of an emulsifier having high anionic activity is especially preferred with the active carrier substances according to this invention in order to produce heavy dyeings. If the emulsifier contains an unduly high percentage of non-ionic emulsifier, it is scarcely possible to dye deep blacks. If on the other hand the emulsifier is anion-active only such as the sulphonates, especially dodecyl benzene sulphonates, the dye tends to build up over-rapidly and the dyeings have poorer than normal rubbing fastness.

Accordingly, the invention also provides a carrier composition comprising 30 to 60 parts by weight of diphenyl, 5 to 35 parts by weight of a phenyl toluene and 5 to 25 parts by weight of fluorene, provided the total of said parts by weight does not exceed 100, and up to 30 parts by weight of other aromatic substances, and an emulsifier. Such carrier compositions are normally either added directly to the dyebath or printing paste or mixed with a suitable dye to form a ready-to-use dyeing preparation.

Although this invention is especially suitable for use in the dyeing of polyester fibres of high melting point, in particular textured goods, other hydrophobic synthetic fibres having a great number of ester groups in the molecule which normally show low dyeability, for example cellulose triacetate and linear polyurethanes, can often be dyed more easily and better with their aid.

The disclosed carriers are especially suitable for dyeing with disperse, vat and developing dyes. Alternatively they can be used to pretreat the goods before dyeing. The normal methods for dyeing and printing disperse dyes from aqueous dispersion are employed, exhaust dyeing at temperatures up to 140° being especially preferred. The dyes are invariably added to the medium in a state of fine division; after dyeing the loose surface colour can be removed by reduction clearing if necessary.

The following Examples illustrate the invention and the parts and percentages are by weight and the temperatures in degrees centigrade.

EXAMPLE 1:

A dyebath is set at 40° with 4000 parts of water containing 2 g/l of anhydrous ammonium sulphate, 0.6 parts of a finely divided 50:50 mixture of the dyes of formulae

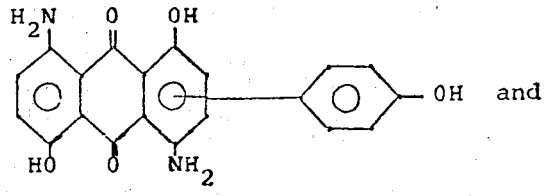

and

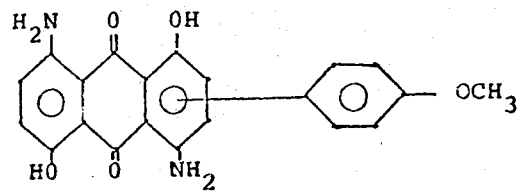

and 10 parts of the carrier-emulsifier mixture I of Example 2 described below, which is emulsified in the bath. The bath is adjusted to pH 5 with formic acid. 100 parts of a polyester fabric are immersed in the bath and the bath is raised to about 97° in 30 minutes and the fabric dyed at this temperature for about 1 hour. On removal it is washed off, rinsed and dried. A level, penetrated dyeing of blue shade is obtained which has excellent fastness properties.

Dyeings of comparable quality are obtained with the aid of the carrier-emulsifier mixtures II and III specified in Example 2.

Fast dyeings of excellent levelness are also obtainable with the dyes of the following formulae:

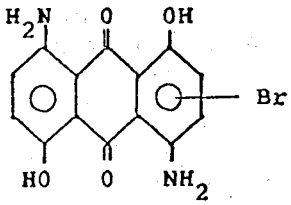

(B) blue

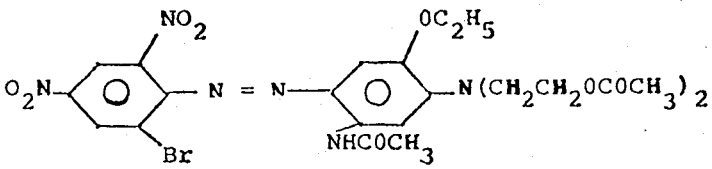

(C) blue

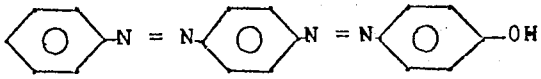

(D) yellow

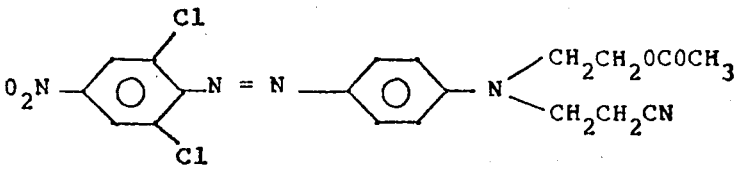

(E) yellow-brown

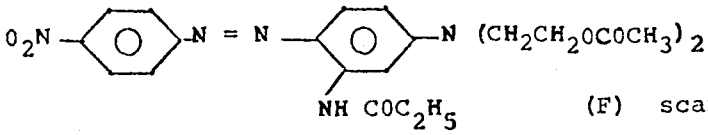

(F) scarlet

EXAMPLE 2:

Carrier-emulsifier mixtures

I. 80 % of a technical mixture of aromatic compounds obtained as a by-product in benzene manufacture and itself consisting of:
- 33 % diphenyl
- 25 % phenyl toluenes
- 15 % fluorene
- 27 % aromatic substances in small amounts (tetrahydronaphthalene, naphthalene, diphenyl ether, diphenyl methane, higher alkylated diphenyl, $C_8$ aromatic substances, anthracene, phenanthrene and other unidentified substances)

5 % paraffin oil

15 % monoethanolamine salt of dodecyl benzenesulphonic acid.

II. 57 % of a technical mixture of aromatic compounds consisting of:
- 60 % diphenyl
- 15 % phenyl toluenes
- 20 % fluorene
- 5 % aromatic substances in small amounts as in I.

10 % diphenyl ether

10 % naphthalene

5 % sodium dinonyl phenoxy- (45.ethoxy)-acetate

1 % sodium dibutyl phenoxy-(7.ethoxy)-acetate

7 % succinic acid diethyl hexyl ester sodium sulphonate

5 % highly sulphonated castor oil containing about 80 % castor oil and about 18 % organically bound $SO_3$ 1 % isobutyl 4 % paraffin oil III. 80 % of a technical mixture of aromatic compounds as in II
- 10 % paraffin oil
- 9 % of the adduct of 40 mols of ethylene oxide on castor oil
- 1 % monoethanolamine salt of dodecyl benzenesulphonic acid.

The technical mixtures of I and II above are commercially available as by-products of the catalytic cracking and dealkylation manufacture of benzene from crude petroleum.

What is claimed is:

1. A composition comprising a dye carrier and an emulsifier, the dye carrier comprising 30 to 60 parts by weight of diphenyl, 5 to 25 parts by weight of methyl biphenyl and 5 to 25 parts by weight of fluorene, provided the total of said parts by weight does not exceed 100, the emulsifier being present in an amount from 5 to 30 weight % based on said carrier.

2. A composition of claim 1, wherein said carrier comprises 45 to 60 parts by weight of diphenyl, 10 to 20 parts by weight of a methyl biphenyl and 8 to 16 parts by weight of fluorene.

3. A composition of claim 1, wherein the carrier comprises, in a further amount from about 1 to about 30 parts by weight, at least, one aromatic compound selected from diphenyl ether, naphthalene, diphenyl methane, tetrahydronaphthalene, anthracene, phenanthrene benzoic acid esters, phthalic acid esters, chloronaphthalenes, o- and p-phenylphenols, o- and p-cyclohexylphenols, alkylphthalimides, salicylic acid esters, cresotinic acid esters, chlorobenzenes, alkoxylated phenols, alkylbenzenes, tetralin, dibenzofuran and mixtures thereof.

4. A composition of claim 3, wherein any alkyl radical or moiety in said aromatic compound is of 1 to 4 carbon atoms.

5. A composition of claim 4, wherein any ester of benzoic, phthalic or terephthalic acid is an alkyl or benzyl ester.

6. A composition of claim 5, wherein said aromatic compounds are selected from naphthalene, diphenyl ether, benzoic acid methyl and ethyl ester and tetrahydronaphthalene.

7. A composition of claim 1, wherein said emulsifier contains at least 60 weight % of an anionic dispersing agent.

8. A composition of claim 7, wherein said emulsifier contains 80 to 95 weight % of an anionic dispersing agent.

9. A composition of claim 7, wherein said emulsifier contains 5 to 15 weight % of a non-ionic dispersing agent.

10. A composition of claim 7, wherein said anionic dispersing agent is selected from sulphonated castor oils, sulphonated oleic acid esters, alkylnaphthalenesulphonates, succinic acid diethyl-hexylester sulphonates, xylene sulphonates, toluene sulphonates and mixtures thereof.

11. A composition of claim 9, wherein said non-ionic dispersing agent is selected from fatty acid esters, alkyl phenol and arylphenolpolyglycol ethers.

12. A composition of claim 9, wherein, where the emulsifier comprises a dispersing agent having more than 25 ethylene oxide units per molecule, such dispersion agent is present to a maximum of 5 weight % in the emulsifier.

13. A composition of claim 1, wherein the dye carrier has a melting point of less than 48°C.

14. A composition of claim 13, wherein the dye carrier has a melting point of less than 40°C.

15. A composition of claim 9, wherein the emulsifier further comprises paraffin oil as emulsion stabilizer and foam inhibitor.

16. A composition of claim 15, wherein the paraffin oil is present in an amount of from 0.1 to 7 % by weight based on the dye carrier.

17. A composition of claim 1 comprising 80 % of a dye carrier mixture, which mixture comprises about 30 weight % diphenyl, about 25 weight % methyl biphenyl, about 15 weight % fluorene and about 25 weight % of other aromatic substances; about 5 weight % paraffin oil; and about 15 weight % of monoethanolamine salt of dodecylbenzenesulphonic acid.

18. A composition according to claim 5, wherein the carrier has a melting point of less than 48°C and the emulsifier contains 80 to 95 weight percent of an anionic dispersing agent.

* * * * *